US006465094B1

(12) United States Patent
Dugan

(10) Patent No.: US 6,465,094 B1
(45) Date of Patent: Oct. 15, 2002

(54) COMPOSITE FIBER CONSTRUCTION

(75) Inventor: Jeffrey Scott Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 09/666,434

(22) Filed: Sep. 21, 2000

(51) Int. Cl.[7] ..... D01F 8/00
(52) U.S. Cl. ..... 428/370; 428/373
(58) Field of Search ..... 428/397, 370, 428/373

(56) References Cited

U.S. PATENT DOCUMENTS

| | | | | |
|---|---|---|---|---|
| 3,705,226 | A | | 12/1972 | Okamoto et al. |
| 3,718,534 | A | | 2/1973 | Okamoto et al. |
| 4,350,006 | A | | 9/1982 | Okamoto et al. |
| 4,381,274 | A | | 4/1983 | Kessler et al. |
| 4,381,335 | A | | 4/1983 | Okamoto |
| 4,496,619 | A | | 1/1985 | Okamoto |
| 4,627,950 | A | | 12/1986 | Matsui et al. |
| 4,663,221 | A | | 5/1987 | Makimura et al. |
| 4,840,846 | A | | 6/1989 | Ejima et al. |
| 4,999,243 | A | | 3/1991 | Maeda |
| 5,366,804 | A | * | 11/1994 | Dugan ..... 428/373 |
| 5,458,972 | A | | 10/1995 | Hagen |
| 5,549,957 | A | | 8/1996 | Negola et al. |
| 5,948,528 | A | * | 9/1999 | Helms et al. ..... 428/373 |

OTHER PUBLICATIONS

Linsbauer et al., "New Polypropylene Hollow Fiber and its Applications in Carpets", *Chemical Fibers International*, Oct. 1999, pp. 390–392, vol. 49.

* cited by examiner

*Primary Examiner*—N. Edwards
(74) *Attorney, Agent, or Firm*—Alston & Bird LLP

(57) ABSTRACT

Multicomponent filaments and methods for their manufacture are disclose, said filaments having a plurality of substantially geometrically-shaped islands formed of a first polymeric material with the islands being surrounded by a sea of a second polymeric material, said sea material having a circular cross-section and forming a center between the islands, from which radiates via a plurality of spokes which connect the center to the sheath, surrounding the islands.

16 Claims, 3 Drawing Sheets

COMPOSITE FIBER CONSTRUCTION

FIELD OF THE INVENTION

The invention generally relates to synthetic fiber constructions having particular physical characteristics. More specifically, the invention relates to multi-component synthetic fibers having a particular component arrangement known as an "island-in-sea" arrangement, which can be readily and easily manufactured, and which provides desirable preselected physical properties.

BACKGROUND OF THE INVENTION

Synthetic fibers are widely utilized in a variety of end uses, including industrial uses, the manufacture of apparel, home furnishings, and the like. The use of synthetic fibers has grown tremendously over the years due in part to their consistency and uniformity. In other words, natural fibers generally vary from fiber to fiber while synthetic fibers, when produced under properly controlled conditions, can be produced to be consistent and to have desired cross-sectional shapes and the like.

Some common methods for producing synthetic fibers include melt and solution spinning. In melt spinning, the fiber-forming material (generally a polymeric material) is melted until it is flowable, then extruded through a spinneret to form filaments of a desired cross-section and diameter. The thus-extruded filaments are then quenched (i.e. cooled) in some manner, such as by contacting them with cool air, drawing them through a liquid bath, etc., to solidify them. These filaments can be used in this form or processed further, such as by drawing them, texturing them, or the like. Similarly, solution spinning also involves the extrusion of a flowable material, with the material in that case being made flowable by providing it or rendering it in solution form.

In the production of some synthetic fibers, it sometimes results that a single polymeric material cannot provide all of the physical properties desired for a particular end use. Therefore, multicomponent fibers have been developed, which enable the physical properties of a plurality of materials to be combined in one fiber. One common type of multicomponent fiber is the sheath/core fiber. In sheath/core fibers, the spinneret is designed so that it feeds a first material to the center of the filament, and a second material so that it forms a sheath covering the first material. Another common type of multicomponent fiber is the side-by-side filament, in which a first material forms one side of the filament and a second material forms the second filament side. These types of filaments are commonly used in the production of crimped yarns, with the first and second materials being selected to behave differently in response to quenching or drawing so that they become crimped during the subsequent manufacturing steps.

Some of the above-mentioned multicomponent sheath/core fibers have so-called "islands-in-sea" orientations. The "sea" component forms the sheath, with the "island" components being the core or cores. Islands-in-sea fibers are known, in which one or more elastomeric core components are surrounded by a sheath designed to be soluble so that when it is removed, the resulting composite structure has one or more elastomeric cores surrounded by a plurality of fine non-elastic ultra-fine fibers. Other fiber orientations are known where two or more different types of material comprise the islands. In such composite fibers, when the sea is removed, super-fine filaments of more than one type are produced.

Islands-in-sea fiber technology has been applied to composite materials where the island material needs protection from outside elements via the sea material, such as, for example, to prevent the core materials that may be abrasive from damaging the material-producing equipment. Various sea configurations are known affecting the mechanical strength of the multicomponent product as a whole. Further, it is known that the core and sheath portions can be composed of either the same kind or different kinds of polymers.

SUMMARY OF THE INVENTION

In one embodiment, the present invention is directed to the production of fibers which can achieve a plurality of physical characteristics and which can be readily and efficiently produced.

In another embodiment, the present invention is directed to multicomponent fibers in which a plurality of geometrically-shaped cores of a first polymeric material are provided within a sea of a second polymeric material, with the second polymeric material forming a plurality of spokes which converge in the center of the fiber. Each of the geometrically shaped cores desirably includes at least two substantially straight sides, and the fibers desirably are circular in cross section. In this way, the cores are preferably formed as a plurality of pie-shaped pieces surrounded by the sea of the second material. The fibers of the present invention are designed to be used in their multicomponent form, with the sea being retained intact during the use of the fiber. In other words, the sea is selected from a material is insoluble in all media which it is designed to encounter, unlike the prior art constructions in which the sea is designed to be dissolved to leave a plurality of independent cores.

According to one embodiment of the present invention, the fibers of the present invention include an outer, or sheath material extending continuously to a central core made from the same material. The continuous connection results in a spoke-like effect, with spokes extending between the generally pie-shaped islands. As a result, the sea material can enhance the fiber resilience and rigidity.

In another aspect of the invention, the sea and island-forming polymeric materials are selected so that the resulting fibers have predetermined visual and refractive properties. For example, a comparatively expensive sea polymer may be selected to have high resiliency and dyeability properties while the islands are formed from a less expensive polymer or a polymer material having a refractive index, which is different from that of the sea-forming material. In this embodiment, the multiple angles formed by the sheath and the spokes of the sea polymer provide surfaces for light scattering. In this way, a fiber having soil-hiding capabilities can be readily achieved that performs better than conventional trilobal soil-hiding performance yarns. Such yarns are desirable in the carpet market, where a sea could be produced from a polymer having good resilience and dyeability, while a less expensive material could be used to form the islands.

In a still further embodiment, the present invention relates to a method for manufacturing a two component island-in-sea fiber. An apparatus for forming synthetic fibers in a spinning direction is provided. The apparatus has a distribution plate oriented perpendicular to the spinning direction, and defines a flow path generally perpendicular to said spinning direction. The plate further has an exit hole extending generally parallel to said spinning direction. A metering plate is positioned downstream of the distribution plate, is oriented in a direction generally perpendicular to the spinning direction, and includes an exit hole extending generally parallel to the spinning direction. The metering plate exit hole forms a common flow path with the distribution plate exit hole. The metering plate exit hole is adapted to moderate the pressure of a material flowing from the distribution plate exit hole through the metering plate exit hole to provide flow of material to a spinneret with a more consistent pressure. The flow of a plurality of materials is directed through the apparatus to form a two-component material having a substantially uniform two-component cross-section.

DETAILED DESCRIPTION OF THE INVENTION

Figure 1:
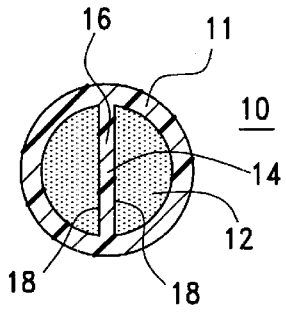
FIG. 1 is a cross-section of a first embodiment of a filament according to the instant invention, having two islands.
Figure 2:
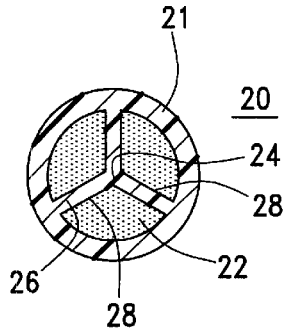
FIG. 2 is a cross-section of a second embodiment of a filament according to the instant invention, having three islands.
Figure 3:
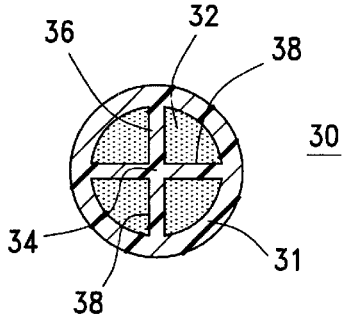
FIG. 3 is a cross-section of a third embodiment of a filament according to the instant invention, having four islands.
Figure 4:
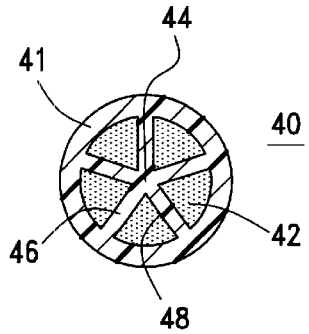
FIG. 4 is a cross-section of a fourth embodiment of a filament according to the instant invention, having five islands.

Other objects, features and advantages of the present invention will become apparent from the following detailed description when taken in conjunction with the accompanying drawings. Like numbers refer to like elements throughout.

The instant invention enables the production of fibers which can achieve a plurality of physical characteristics and which can be readily and efficiently produced. As illustrated in FIGS. 1–4, the fibers, 10, 20, 30 and 40, have cross-sections which define a plurality of substantially geometrically-shaped islands 12, 22, 32, 42. In a preferred form of the invention, the islands are generally pie-shaped. This is the result of the sea material comprising a circumferential sheath surrounding the exterior of the fiber that has a substantially circular cross-section. The sea material is manufactured to have continuous section extend from the circumference of the sheath 11, 21, 31, 41 inward to a central region 14, 24, 34, 44. These extensions or spokes 16, 26, 36, 46 comprise substantially parallel walls 18, 28, 38, 48 resulting in substantially linear spokes. As is shown in the drawings, according to the present invention, the number of spokes may vary. However, each specific embodiment uses a sea material to comprise the sheath. The spokes are integrated into the sheath and extend linearly from the interior of the sheath to the central core region near the center of the fiber where the spokes converge.

Figure 5:
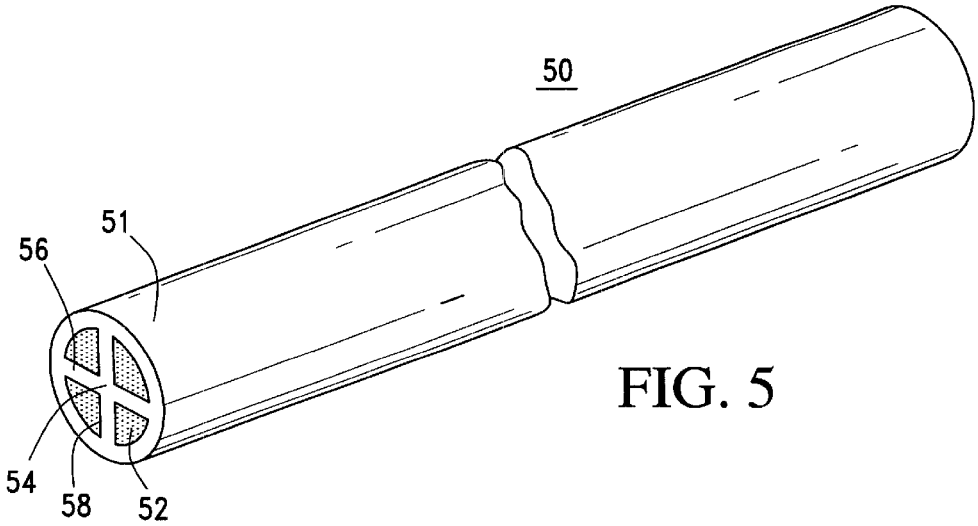
FIG. 5 is a perspective view of the sea material of the filament.

A material which preferably is different from the sea material fills the spaces left within the spoke-like configuration created by the sea material, and becomes the islands 12, 22, 32, 42. The islands preferably completely fill the spaces and, therefore, the island edges are in intimate contact with the sea spokes and the interior surface of the sheath. FIG. 5 shows a perspective view of the formed two-component fiber 50 with the sea material in the form of an integrated sheath 51, spokes 56 and central core region 54. The island material substantially fills the area between adjacent spokes 56, and forms the substantially pie-shaped islands 52.

The preferred materials used to make the sea include polyactide or poly lactic acid, thermoplastic elastomers, ionomers, polycarbonate, flouropolymers, polyesters such as polytrimethyl terephthalate, PBT, PCT, and PEN, acetals, polyphenyl sulfides, polystyrenes, polyvinyl polymers, polyesters, polyamides and polyolefins such as polyethylene and polypropylene, acrylonitrile-based copolymers, and saponified ethylene-vinyl acetate copolymers, polyactide or poly lactic acid, thermoplastic elastomers, ionomers, polycarbonates, fluoropolymers, polytrimethyl terephthalate, actyls, polyphenyl sulphide, and mixtures, blends and alloys made therefrom, with polyesters and polyamides being particularly preferred.

The same materials listed above may also be used as the island material. It is understood that identical materials would not be used simultaneously for sea and island materials. However, the same general polymer could be used for both the sea and island materials if differentiated by some factor such as additive content or molecular weight. Particularly preferred materials used to make the islands include traditionally inexpensive materials such as polypropylene and polyethylene terephthalate.

It is to be understood that other known fiber-forming compounds may be used in combination with each other as desired to achieve the desired properties for the combination. Such properties to be taken into account include without limitation, modulus, elasticity, refractive index, density, dyeability, resiliency, cost, chemical resistance, hydrolysis resistance, conductivity, surface friction, wettability, UV stability, flame resistance, softening/melting temperature, etc.

According to the present invention, the geometric configuration of the sea material provides an enhanced structural rigidity to the fiber. The use of substantially linear spokes converging to a central hub or core region provides a "wagon-wheel" orientation that serves to dissipate forces more evenly and uniformly throughout the structure. For example, for a given wall thickness for the sea material, the fiber's rigidity increases as the number of spokes increases. This dynamic allows the manufacturer to achieve the desired fiber rigidity, and other properties, by tailoring the geometric design, along with sea wall thicknesses at the sheath and the spokes.

Through the present invention, material cost can be reduced in a number of ways. For example, once a particular overall rigidity need and cost for a particular fiber to be manufactured is determined, the material engineer can use the present invention to achieve the desired product. The cost may affect the island material to be used. If the island material does not provide enough rigidity to the overall finished component, but is desirable in every other way, the geometric configuration of the sea can be altered to provide greater rigidity. In addition, if the amount of sea material available is at issue (due to cost, shortage, etc.), the sheath and spoke wall thickness of the sea can be reduced without adverse impact on the finished product by selecting a more rigid geometric sea configuration, e.g., more spokes.

The island material is often selected on the basis of its inherent properties in relation to the properties of the sea material. The island material cooperates with the sea material to lend an overall density, resilience and rigidity to the fiber. The sea and island materials, as well as the preferred geometry, can be selected to have complementary properties to achieve a desired characteristic.

In conventional two-component filled fibers, filling the sheath with a less expensive core material often results in a loss of some of the sheath polymer's desirable resiliency. Further, if the core and sheath materials melt or deform at different rates, the fiber cross-section may be disadvantageously flattened or altered. Two-component fibers having round island fibers are known. The use of round islands has been required due to an inability to fashion islands having any other cross-sectional shape. Unfortunately, the geometry of round islands limits the sheath:core polymer ratio to a certain minimum value, at which point the round islands are so large that they touch each other, eliminating any geometric structural usefulness.

The present invention addresses these shortcomings by using an island material regularly intersected by the sheath material extending inwardly from the outer sheath in a spoke-like fashion, with the spokes converging at a center core. The islands of the present invention are able to maintain their structurally cooperative wedge shape to reinforce the sheath/spoke, or sea material. By using the wedge-shaped islands, the sheath:core or sea:island polymer ratio can be reduced to unanticipated limits by reducing the diameter of the sheath wall and spokes.

Further, the wedge shape is unexpectedly useful for soil-hiding light scattering. The sea and island materials can be selected based on their differing refractive indices to create the proper look and feel for the resulting material. Appropriately varying refractive indices between the sea and island materials can affect material performance and create certain predictable optical effects. In one preferred embodiment, the multiple angles formed by the sheath and the spokes of the sea polymer provide surfaces for light scattering. In this way, a fiber having soil-hiding capabilities can be readily achieved, which, in some cases, may perform at a level superior to that of conventional trilobal soil-hiding performance yarns. Such yarns have particular utility in the carpet market, where a sea can be produced from a polymer having good resilience and dyeability, such as nylon, while a less expensive material could be used to form the islands.

The above-identified preferred materials for the sea and islands typically have refractive indices from about 1.35 to about 1.65 $n_D^{25}$. However, various additives can be provided to the molten materials or can be provided as an after-treatment to the materials to influence the material's refractive index such that the listed materials can have an approximate refractive index range of from about 1.25 to about 1.75 $n_D^{25}$. According to the present invention, acceptable soil-hiding fiber characteristics have been appreciated when the refractive indices of the two materials in the finished two-component fibers differ by about 10%.

In another preferred embodiment, to be useful, in certain applications, the finished fiber material must be dyeable to a desired degree. Ideally the sea material, due to its presence on the fiber's exterior, must be a highly dyeable material. As a result, the sea material is often more expensive than the island material, which need not have dyeable properties. In this way, the composite component approach, yields a cost-effective fiber, since only the very thin exterior of the fiber uses the expensive dyeable material.

It is further understood that the present invention contemplates the addition of non-interfering additives that enhance the desired performance and effect of the finished fibers. For example, bonding agents or coupling agents may be provided to the island/sea interface to produce desired effects. Compatibilizing agents include copolymers functionalized with maleic anhydride, acrylic acid, and epoxides. Various other modifying or inert surfactants may be added to improve the workability of the sea and island polymers. In addition, the present invention contemplates preferably incorporating additives such as pigments, antimicrobial agents, flame retardants, antiblock compounds, UV absorbers, antioxidants, etc.

In one preferred embodiment, the two-component filament of the present invention, is made according to the following procedure that is the subject of co-pending and commonly assigned U.S. patent application Ser. No. 09/137,435, filed Aug. 20, 1998, which is incorporated by reference in its entirety as if made a part of the present application. Two polymers are extruded in separate extruders, each of which feeds a separate metering pump. The respective molten polymers are then pumped individually into a stack of metal plates with flow channels. The channels divide the polymer into separate streams that are then combined at the upstream side of a spinneret hole in the metal plates. The combining of the streams is preselected to achieve the desired resulting cross-section of the two-component resulting filament. According to the present invention, the particularly preferred shape for the island polymer is a wedge shape. The selected cross-section is maintained as the polymer flows through and out of the spinneret hole.

For example, in some instances, the size of the metering plate parallel exit hole(s) and the thickness of the metering plate can be specially dimensioned to produce a defined pressure increase in the flowable material. In fact, the metering plate parallel exit hole(s) and/or the thickness of the metering plate can be sized to produce a pressure on the flowable material as it exits the metering plate which is alone sufficient for balanced-pressure feed to the spinneret, thereby essentially obviating the need for upstream pressurization means.

In the action of the spinneret, it is typically advantageous to have the flowable material oriented in a parallel condition relative to the spinning direction before it enters the spinneret. Thus the metering plate parallel exit hole, in a preferred embodiment, orients the flowable material to produce a parallel oriented flowable material, which is distributed to the spinneret.

In one embodiment of the present invention, a second metering plate is also positioned above the distribution plate. In this embodiment, the metering plate provides flowable material to the distribution plate at an initial substantially constant pressure, with material pressure being re-equilibrated upon exit from the distribution plate by the first metering plate.

Typically, a spinneret has a plurality of backholes and mating exit orifices in order that a number of fibers can be spun simultaneously. Therefore, the metering plates preferably used to make the fibers of the present invention desirably have at least one parallel exit hole which mates with each of the spinneret backholes, which are intended to be active during the spinning process. For some applications, it is advantageous to provide a plurality of flowable material streams to a single spinneret backhole. In light of this, in one embodiment of the invention, the metering plate has a plurality of parallel exit holes for each spinneret backhole. At least a portion of each of the parallel exit holes of the plurality is smaller than the distribution plate exit hole. The plural parallel exit holes of the metering plate receive the flowable material from the distribution plate parallel exit hole and output plural flowable material streams. The metering function of the holes causes the material to flow at equilibrated pressure through each metering hole fed by the larger, corresponding distribution plate exit hole, rather than flowing preferentially through the metering hole nearest the channel feeding the distribution plate exit hole. In this way, the plural material streams can be fed to a single spinneret backhole as desired, thereby enabling the pattern of stream feeding to approximate the shape of areas of particular materials in the fiber to be produced. Such a feeding arrangement has particular advantages in the production of multi-component fibers, as it provides a high degree of preciseness in the feeding of the stream to the backhole of the spinneret while at the same time, maintaining consistent pressure between the plural streams.

In many applications using this multi-stream embodiment, it is advantageous to have equilibrium between each individual stream of the plurality of flowable material streams. Therefore, in this embodiment, the size of the exit holes of the plurality of metering plate exit holes and the thickness of the metering plate are desirably sufficiently uniform such that the pressure of any one of the plurality of streams is approximately equilibrated to the pressure of any other stream of the plurality of flowable material streams as they exit the metering plate and flow toward the spinneret.

To produce the synthetic fibers of the present invention, where the fiber contains many shaped aspects, such as a shaped core and shaped outer sheath, the distribution plate exit hole can be formed in a predetermined shape for producing and distributing a flowable material stream with a predetermined shape. In this embodiment, the metering plate is desirably configured such that a plurality of metering plate exit holes correspond to at least one of the distribution plate exit holes. The plurality of exit holes of the metering plate which receive each of the shaped flowable material streams then output to the spinneret a plurality of flowable material streams which collectively substantially maintain the predetermined shape. In a particularly preferred embodiment, the plurality of exit holes in the metering plate outputs to a spinneret backhole a plurality of flowable material streams, wherein the pressure of one flowable material stream is approximately equilibrated to the pressure of any of the other flowable material streams.

Figure 6:
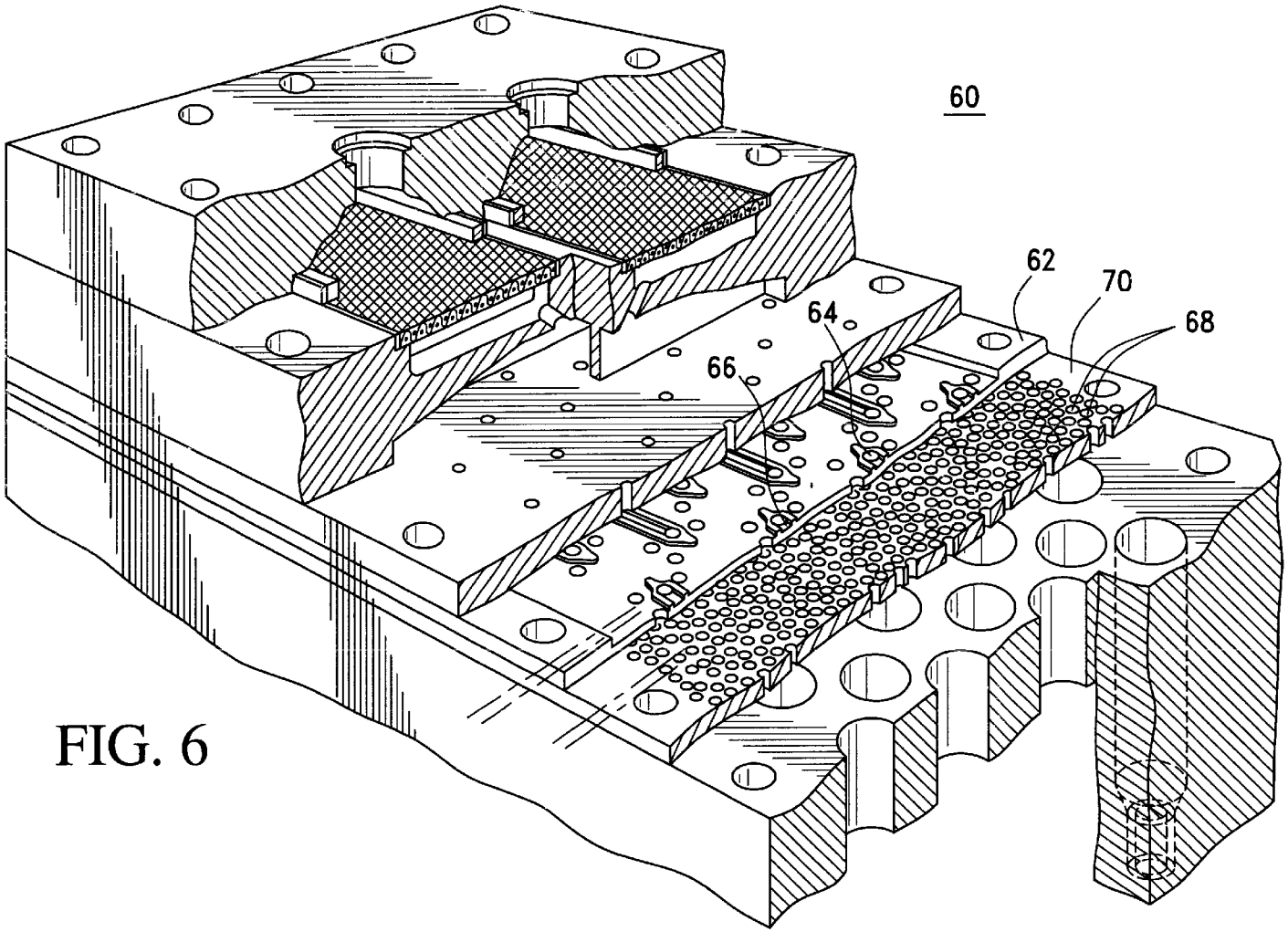
FIG. 6 is an exposed view of a stacked plate finer-forming apparatus assembly.

For illustration purposes, FIG. 6 shows an exposed sectional view of a fiber-forming stacked plate assembly 60 useful in connection with making the preferred two component fibers. In the production of fibers of this type, the synthetic fiber forming apparatus 60 has a distribution plate 62 which has shaped exit holes 64 which approximate the cross-sectional shape of the fiber to be produced. With respect to the present invention, the shapes of the exit holes 64 are designed such that their combined shape roughly approximates the cross-sectional shapes, shown in FIGS. 1–4, of the desired synthetic fiber. Generally, the flow paths 66 distribute flowable material to the distribution plate shaped exit holes 64, wherein the flowable material roughly fills the cross-sectional dimension of the distribution plate exit holes 64. The distribution plate exit holes 64 produce and distribute shaped, flowable material streams to the plurality of exit holes 68 of the metering plate 70, which is desirably positioned beneath the distribution plate 62.

Figure 7:
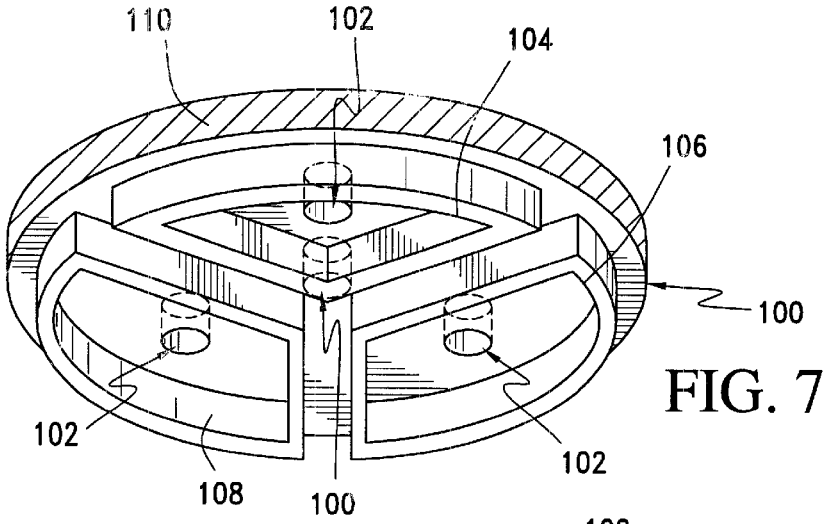
FIG. 7 is a perspective view of a single position of the underside of a distribution plate.
Figure 8:
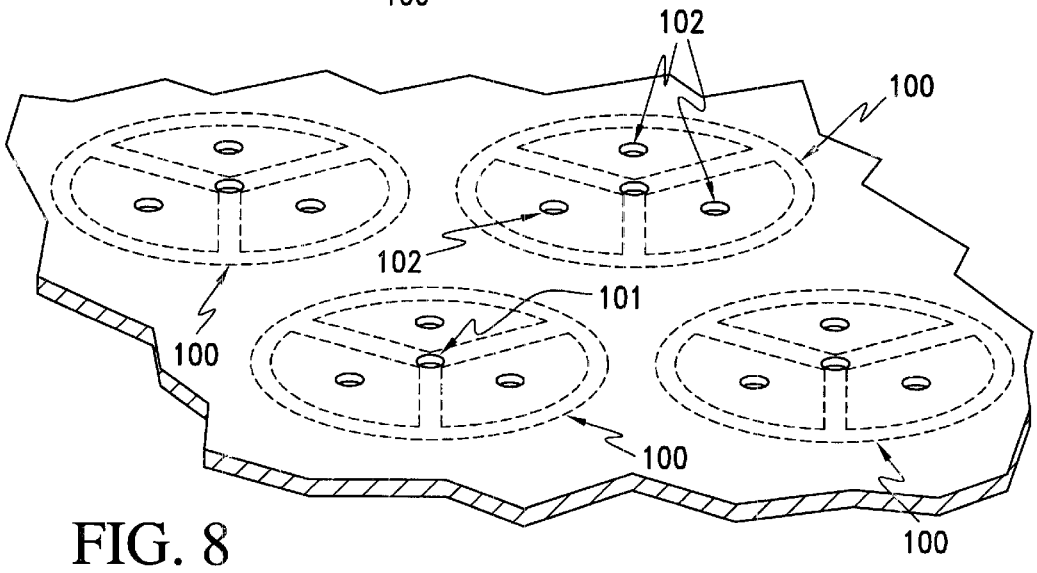
FIG. 8 is a perspective view of the top of a distribution plate.
Figure 9:
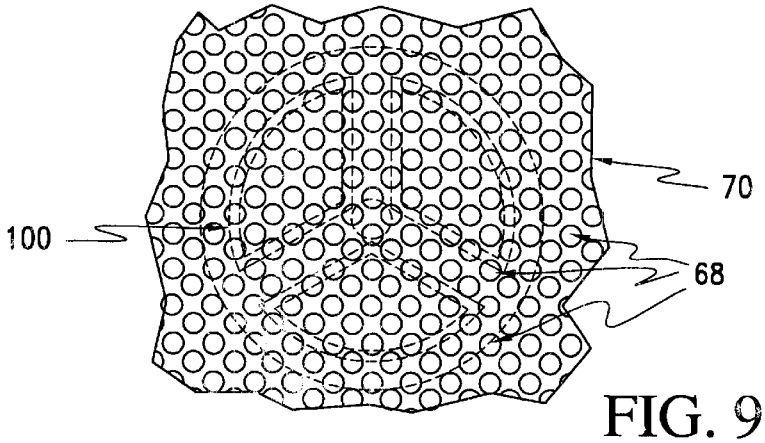
FIG. 9 is a segmented enlarged view of the apertures in a metering plate.

FIG. 7 shows a view of a single position of the underside of plate 62. The configuration 100 is repeated at each spinneret backhole, and forms one fiber cross-section per replication. The flowable "sea" material flows through aperture 101 to make the "sea" portion of the fiber. The flowable "islands" material flows through apertures 102 to make the "islands" portion of the fiber. Barriers 104, 106, 108, 110 serve to restrict the island material from prematurely contacting the sea material. FIG. 8 is a close-up representation of the "top" view of plate 62, showing aperture 101 and multiple apertures 102. Finally, FIG. 9 is a segmented enlarged view of the apertures 68 in plate 70, with the pattern 100 represented by phantom lines, as viewed from the underside of plate 70.

Once the stream emerges from the spinneret exit hole, the filament is then frozen in a heat transfer medium such as a stream of cold air or a water bath. The solid filament is then taken up on a spinning wheel. The preferred spinneret has multiple spinneret holes, each individually fed by separate streams of both polymers, so as to form a bundle of multiple filaments, at least some of which (and typically all of which) have the desired island/sea cross-section with wedge-shaped islands. The take-up wheel may deliver the fiber to subsequent sets of wheel running at faster speeds to stretch or "draw" or otherwise alter the fiber as would be understood by one skilled in the textile field. The drawn or undrawn fiber may then be taken up on a bobbin or plaited into a can, for example. If undrawn, the fiber may be drawn in a subsequent process. Further the drawn or undrawn fiber may be crimped and cut to a desired cut length to produce "staple" fiber.

The first and second polymeric materials forming the islands and the sea preferably are desirably high molecular weight polymers, polyamides and copolymers thereof, polyethylene terephthalates and their copolymers, polyolefins, and blends thereof. However, the invention is not intended to be limited to any particular material, with the type utilized being selected to provide the properties desired. The materials are selected to be extrudable through a spinneret to achieve the desired cross-sectional shapes. As noted above, according to the present invention, the first polymeric material can be selected to be less expensive than the material forming the sea of the fibers, since it will be fully encompassed by the second polymeric material. In addition, the polymeric material forming the islands is selected to be generally non-abrasive, while the second polymeric material used to form the sea is designed to be insoluble in materials, which the filaments may encounter. In other words, the sea forms an integral part of the finished filaments and is not designed to be dissolved away as in some of the prior art structures.

In a preferred embodiment, the present invention is directed to multicomponent fibers in which a plurality of geometrically-shaped cores of a first polymeric material are provided within a sea of a second polymeric material, with the second polymeric material forming a plurality of spokes which converge in the center of the fiber. Each of the geometrically-shaped cores radiate from the core at predetermined angles, in the form of substantially linear walls, thus creating substantially straight spokes that extend to, and are integral with the filament sheath. As already stated, the fibers desirably are circular in cross section. In this way, the cross-section of the core appears preferably "pie-shaped", with the sheath/core or "sea" material surrounding the pie-shaped island material. It is understood that, if the walls are substantially linear, the wall thickness is substantially constant along the length of the wall. In other words, the diameter of the wall along its length is substantially constant. However, if desired, the walls can be made such that the thicknesses of the spoke walls, or spoke and outer walls, are intentionally varied over their lengths.

The fibers of the instant invention therefore include a sheath of a second material, which maintains a connection to a center core of the same material, by way of the spokes of the sea material, which extend between the generally pie-shaped islands. As a result, the sea material can enhance the fiber resilience and rigidity. Furthermore, the material used to form the islands, in some aspects of the invention, can be selected to be a less expensive material than that used to form the sea portion of the fibers. In this way, the ratio of island to sea material can be selected to achieve the desired physical properties at the lowest possible cost. Accordingly, the present invention gives material and textile engineers great flexibility in material selection during fiber formation.

Because the fibers of the instant invention have circular outer cross-sectional shapes, they can be produced using a bicomponent spinning machine and round spinneret holes. Such arrangements enable the production of fibers at low cost. Further, since the round spinneret holes can be packed densely, the fibers can be produced at high rates of production. In addition, spinneret production is simplified by allowing for spinneret holes to be drilled into the metal plates, rather than being cut into the plates. This results in a substantial cost savings with respect to the overall fiber production method.

Two other methods of forming nonwoven from fibers begin at the fiber extrusion stage. One method, known as melt-blowing, entails blowing apart the extruded fibers by high-velocity air streams into small molten fibers that fall onto a screen and bond to each other. Another method, known as spunbonding, entails solidifying the extruded fibers in continuous filament form before falling onto a belt where the fibers form a web that is later bonded together, typically by heat such as a calendar.

The fibers according to the instant invention can be used in their filament form, or they could be chopped into staple fibers, spunbond or melt-blown to form fabrics, or the like. Fibers that are not cut (filament yams) may be formed into fabrics by knitting or weaving, optionally in combination with other yarns. Staple fibers may be spun, optionally in combination with other staple fibers, into spun yarns. These yarns can be formed into fabrics by knitting or weaving. Staple fibers, optionally in combination with other staple fibers, also may be formed into nonwoven fabrics by wet-laid processes, such as paper-forming, by air-laid processes, or by carding to form a card web that can be subsequently strengthened by thermal bonding, chemical bonding, needlepunching, stitchbonding or hydroentangling.

The following examples serve only to further illustrate aspects of the present invention and should not be construed as limiting the invention.

EXAMPLE 1

In a bicomponent spinning system, one extruder is fed with Marlex HGZ-180 polypropylene (PP) (Philips Sumika). The second extruder is fed with PCT 3879 thermoplastic polyester (PCT) (Eastman Chemical Co.). The polypropylene is extruded at 265° C. to a gear pump, which pumps the PP into a spin pack with 175 holes. The PCT is extruded at 300° C. to a gear pump, which pumps the PCT into the same spin pack with the PP. The two pumps are operated at 49.5 and 33 rpm respectively, to give melt volume polymer ratios in each fiber of 60% PP and 40% PCT. Channels in the spin pack divide the polymer flows and deliver both polymers to each spinneret backhole in an arrangement that creates a concentric sheath/core cross-section with a PP core surrounded by a sheath of PCT. Upon exiting the spinneret, the fibers are quenched in 30° F. air flowing at 1688 $ft^3$/min. The fibers are taken up on godets that feed a winder running at 400 m/min. The fiber denier at this point is 40.9 denier per filament. These fibers are subsequently drawn at a draw ratio of 3:1 and heat set at 164° C., yielding a fiber with a drawn denier of 15 denier per filament.

EXAMPLE 2

In a bicomponent spinning system, one extruder is fed with Marlex HGZ-180 polypropylene (PP) (Philips Sumika). The second extruder is fed with PCT 3879 thermoplastic polyester (PCT) (Eastman Chemical Co.). The polypropylene is extruded at 265° C. to a gear pump, which pumps the PP into a spin pack with 175 holes. The PCT is extruded at 300° C. to a gear pump, which pumps the PCT into the same spin pack with the PP. The two pumps are operated at 49.5 and 33 rpm respectively, to give melt volume polymer ratios in each fiber of 60% PP and 40% PCT. Channels in the spin pack divide the polymer flows and deliver both polymers to each spinneret backhole in an arrangement that creates an islands/sea cross-section with three round PP islands in a PCT sea. At this polymer ratio, the PP islands begin to touch each other. At higher PP:PCT polymer ratios, the radial PCT spokes would not connect at the fiber's center. Upon exiting the spinneret, the fibers are quenched in 30° F. air flowing at 1688 $ft^3$/min. The fibers are taken up on godets that feed a winder running at 500 m/min. The fiber denier at this point is 38.3 denier per filament. These fibers are subsequently drawn at a draw ratio of 3:1 and heat set at 164° C., yielding a fiber with a drawn denier of 15 denier per filament.

EXAMPLE 3

In a bicomponent spinning system, one extruder is fed with Marlex HGZ-180 polypropylene (PP) (Philips Sumika). The second extruder is fed with PCT 3879 thermoplastic polyester (PCT) (Eastman Chemical Co.). The polypropylene is extruded at 265° C. to a gear pump, which pumps the PP into a spin pack with 175 holes. The PCT is extruded at 300° C. to a gear pump, which pumps the PCT into the same spin pack with the PP. The two pumps are operated at 49.5 and 33 rpm respectively, to give melt volume polymer ratios in each fiber of 60% PP and 40% PCT; Channels in the spin pack divide the polymer flows and deliver both polymers to each spinneret backhole in an arrangement that creates an islands/sea cross-section with three wedge-shaped PP islands in a sea of PCT. Straight walls of PCT separate the islands of PP, which do not touch each other, even at a polymer ratio 50% richer in PP than that shown in Example 2. Upon exiting the spinneret, the fibers are quenched in 30° F. air flowing at 1688 $f^3$/min. The fibers are taken up on godets that feed a winder running at 400 m/min. The fiber denier at this point is 40.9 denier per filament. These fibers are subsequently drawn at a draw ratio of 3:1 and heat set at 164° C., yielding a fiber with a drawn denier of 15 denier per filament.

Upon testing, it is observed that the resiliency and light-scattering properties of the fiber of Example 3 are greater than those of the fiber of Example 1. Further, the polymer cost of the Example 3 fiber is equivalent to that of Example 1, and less than the cost of the Example 2 fiber. This is due to the higher proportion of the lower-cost PP used in the Example 3 fiber.

Many other modifications and variations of the present invention are possible to the skilled practitioner in the field in light of the teachings herein. It is therefore understood that, within the scope of the claims, the present invention can be practiced other than as herein specifically described.

That which is claimed:

1. A multi-component filament comprising:

a plurality of substantially geometrically-shaped islands made from a first polymeric material having a refractive index of from about 1.25 to about 1.75 $n_D^{25}$, said islands having an outer surface; and a sheath region having an outer surface and an inner surface and made from a sea material, said sea material made from a substantially insoluble second polymeric material having a refractive index of from about 1.25 to about 1.75 $n_D^{25}$, with the sea material extending continuously from a plurality of points about the outer surface to a core region substantially at the center of the filament and surrounding the islands, the multi-component filament drawn at a draw ratio of 3:1.

2. The filament according to claim 1, wherein the outer surface of the islands are proximate to the inner surface of the sheath region.

3. The filament according to claim 1, wherein the first polymeric material is non-abrasive.

4. The filament according to claim 1, wherein the sea material comprises at least two spokes extending inward from the sheath region to the core region.

5. The filament according to claim 4, wherein the spokes comprise walls having a substantially constant diameter along their length.

6. The filament according to claim 5, wherein the walls are substantially linear.

7. The filament according to claim 1, wherein the sheath region has a substantially uniform thickness.

8. The filament according to claim 5, wherein the walls and sheath region have a substantially uniform thickness.

9. The filament according to claim 1, wherein the filament has a substantially circular cross-section.

10. The filament according to claim 1, wherein the islands are made from materials selected from the group consisting of polyamides and their copolymers, polyethylene terephthalates, therephthalate copolymers, polyolefins, and combinations thereof.

11. The filament according to claim 1, wherein the insoluble second polymeric material is selected from the group consisting of polyamides and their copolymers, polyethylene terephthalates, terephthalate copolymers, polyolefins, acrylonitrile-based copolymers, saponified ethylene-vinyl acetate copolymers and combinations thereof.

12. The filament according to claim 1, wherein the difference between the sea material refractive index and island material refractive index is at least about 10%.

13. A filament according to claim 1, wherein said plurality of substantially geometrically-shaped islands comprises at least two islands.

14. A filament according to claim 1, wherein said islands have substantially pie-shaped cross-sections.

15. A multi-component filament having a cross-section comprising:

a plurality of substantially pie-shaped islands made from a first polymeric material having a refractive index of from about 1.25 to about 1.75 $n_D^{25}$, said pie-shaped islands being oriented to extend outwardly from a center region made from a second insoluble polymeric material having a refractive index of from about 1.25 to about 1.75 $n_D^{25}$;

a plurality of spokes formed of said second material extending outwardly from said center region such that a spoke borders each adjacent island; and a sheath formed of said second insoluble polymeric material, said sheath having a generally circular outer cross-section substantially surrounding said islands and said spokes such that said spokes connect said sheath to said center region, the multi-component filament drawn at a draw ratio of 3.1.

16. The filament according to claim 15, wherein the sheath and spokes have a substantially similar wall diameter.

* * * * *

UNITED STATES PATENT AND TRADEMARK OFFICE

CERTIFICATE OF CORRECTION

PATENT NO. : 6,465,094 B1
DATED : October 15, 2002
INVENTOR(S) : Dugan

It is certified that error appears in the above-identified patent and that said Letters Patent is hereby corrected as shown below:

Title page,
Item [56], References Cited, U.S. PATENT DOCUMENTS, "Helms et al." should read -- Helms, Jr. et al. --.

Column 3,
Line 25, cancel "and";
Line 26, "finer" should read -- fiber --;
Line 27, after "assembly" the period (.) should be a semicolon (;).

Column 12,
Line 38, "3.1" should read -- 3:1 --.

Signed and Sealed this

Twenty-ninth Day of April, 2003

JAMES E. ROGAN
*Director of the United States Patent and Trademark Office*